US006231718B1

(12) United States Patent
Tsai

(10) Patent No.: US 6,231,718 B1
(45) **Date of Patent: *May 15, 2001**

(54) TWO PHASE OZONE AND OXYGEN PULP TREATMENT

(75) Inventor: Ted Yuan Tsai, Harriman, NY (US)

(73) Assignee: International Paper Company, Purchase, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 07/843,833

(22) Filed: Feb. 28, 1992

(51) Int. Cl.[7] ..... D21C 9/147; D21C 9/153
(52) U.S. Cl. ..... 162/57; 162/65; 162/78
(58) Field of Search ..... 162/65, 57, 88, 162/89

(56) References Cited

U.S. PATENT DOCUMENTS

| | | | | |
|---|---|---|---|---|
| 3,663,357 | | 5/1972 | Liebergott | 162/65 |
| 3,719,552 | | 3/1973 | Farley et al. | 162/65 |
| 4,080,249 | | 3/1978 | Kempf et al. | 162/57 |
| 4,196,043 | | 4/1980 | Singh | 162/30 K |
| 4,216,054 | | 8/1980 | Bentvelzen et al. | 162/57 |
| 4,372,812 | | 2/1983 | Phillips et al. | 162/40 |
| 4,568,420 | | 2/1986 | Nonni et | 162/65 |
| 4,626,319 | | 12/1986 | Kruger et al. | 162/65 |
| 4,959,124 | * | 9/1990 | Tsai | 162/89 |
| 5,011,572 | | 4/1991 | Parthasarathy et al. | 162/56 |
| 5,133,946 | * | 7/1992 | Schwarzl | 162/65 |

FOREIGN PATENT DOCUMENTS

| | | |
|---|---|---|
| 1251903 | 4/1989 | (CA) . |
| 5390402 | 1/1977 | (JP) . |
| 5390403 | 1/1977 | (JP) . |

OTHER PUBLICATIONS

Singh, "The Bleaching of Pulp", Tappi Press, Atl., 1979.*
Eachus, Spencer W., "Atmospheric–pressure Oxygen Bleaching", TAPPI, vol. 58, No. 9, pp. 151–154, Sep. 1975.
Ingersoll–Rand Pulp Machinery Brochure, "Gas Phase Ozone System", 6 pages, Oct. 1991.

* cited by examiner

*Primary Examiner*—Steve Alvo
(74) *Attorney, Agent, or Firm*—Luedeka, Neely & Graham, P.C.

(57) ABSTRACT

In the post-digestion treatment of kraft cellulosic pulp, the improvement comprising subjecting the pulp to a two-phase process in which the two-phases are substantially identical and each phase includes contacting the pulp first with an ozone/oxygen mixture at a temperature below about 60° C. and thereafter with oxygen with the pulp at a temperature above about 65° C.

6 Claims, 2 Drawing Sheets

TWO PHASE OZONE AND OXYGEN PULP TREATMENT

This invention relates to the post-digestion treatment of cellulosic kraft pulps, particularly for the purpose of enhancing the delignification of the pulp.

Post-digestion treatment of kraft pulps to enhance their delignification, in the prior art, has included various bleaching sequences. Chlorine-containing bleaching agents have been used extensively because of their effectiveness and other reasons. These prior art processes have now been questioned as contributing to the generation of dioxins, chlorinated organics, and other objectionable compounds. Consequently extensive work has been conducted and is continuing on ways to avoid the problems associated with the use of chlorine-containing compounds in the post-digestion treatment of pulps. Among these efforts, it has been suggested that chlorine-containing compounds be eliminated from the post-digestion treatments and that oxygen, ozone, peroxide, be substituted therefor. These non-chlorine-containing elements or compounds, however, suffer from several disadvantages. First, many of these proposed substitute materials represent increased exposure in treating the pulps, this expense being either in the form of added raw material costs and/or by reason of the necessity of adding new processing equipment or modifying existing processing equipment. Second, many are less effective than the chlorine-containing materials. Third, even though certain of these prior art proposed substitute materials may be effective in achieving target brightness of the pulp, they adversely affect one or more of the other properties of the pulp, such as its viscosity. Fourth, some of the substitute materials, such as ozone, are highly reactive, hence are difficult or impossible to economically handle.

It is therefore an object of the present invention to provide a post-digestion treatment method for kraft cellulosic pulps which represents an improvement in effectiveness.

It is a further object to provide a post-digestion treatment for kraft cellulosic pulps in which there is no chlorine-containing bleaching agent employed in the treatment.

Briefly, the present inventor has found that target delignification values for kraft cellulosic pulps may be obtained by means of a two-phase post-digestion treatment of the pulp which includes, in the first phase, contacting, in a mixer, the digested, washed pulp at an acidic to low alkaline pH with a mixture of ozone and oxygen, at between about 60 and 80 psig, in an initial stage. The ozone/oxygen mixture introduced to the pulp in the mixer contains between about 3% and about 12% ozone with the remainder being essentially oxygen Thus, the quantity of ozone, on pulp, is between about 0.15% and about 0.5%. The mixture is added to the pulp while the pulp is maintained at a temperature that is below that temperature at which oxygen will react with the components of the pulp but at or above the temperature at which the ozone will react with the components of the pulp. After the ozone in the mixture has been substantially consumed by reaction with components of the pulp, the pulp is thereafter adjusted in pH to a medium to high alkaline pH, as by the addition of caustic, and the temperature of the pulp is increased to a temperature at which the oxygen remaining in the pulp, or addition oxygen as required, will react with components of the pulp. The pulp is maintained at such acceptable temperature for a time period sufficient for at least a major portion, and preferably substantially all, of the oxygen to be consumed in the reactions. Thereafter, the pulp is washed as by a water wash. Following this washing step, the washed pulp is again provided with a repeat treatment which is substantially the same as that set forth hereinabove, beginning with the step of contacting the pulp with a further ozone/oxygen mixture in a mixer and continuing through the washing step.

In accordance with one aspect of the invention, a peroxide may be added to the pulp following consumption of the ozone by reaction with the pulp or, alternatively, before the addition of the ozone/oxygen mixture. In accordance with a further aspect of the invention, a portion of the oxygen remaining in the pulp following consumption of the ozone by reaction may be removed, as by off-gassing, either before addition of the alkali for upward adjustment of the pH of the pulp to the alkaline state, or after such pH adjustment. Still further, the ozone/oxygen mixture may be added to the pulp by means of two, or even more, mixers for the purpose of dividing the task of adding the ozone to the pulp and/or for providing for the addition of larger quantities of ozone to the pulp.

BRIEF DESCRIPTION OF THE DRAWINGS

Other aspects and advantages of the present invention will be recognized from the following description and claims, including the drawings, in which:

With reference to FIG. 1, there is depicted one embodiment of a process in which an unbleached digested kraft pulp 10 at an acidic pH and a consistency of between about 1% and 45%, is fed into a first mixer 12 of conventional design. As shown, a mixture of ozone and oxygen from a conventional ozone generator 14 at 15 psig is compressed in a compressor 16 to a pressure of between about 60 and 80 psig and also introduced into the first mixer. The temperature of the pulp in the mixer 12 is established and maintained at or above the temperature at which the ozone will react with components of the pulp, but lower than the temperature at which oxygen in the mixture will react with components of the pulp. In this manner, the ozone preferentially reacts with components of the pulp, and does so very quickly, e.g. within less than about 1 to 15 minutes and often within less than 10 seconds. The pulp, containing substantially all the oxygen from the ozone/oxygen mixture, is thereafter fed to a second mixer 17 at which the pH of the pulp is increased to an alkaline state as by the addition of caustic and the temperature of the pulp is increased to a temperature, as by the addition of steam to the pulp, at which the oxygen will react with components of the pulp. Although not depicted, peroxide may be also added to the pulp in the second mixer 17. Alternatively, this peroxide may added to the pulp ahead of the first mixer 12. In either event, the peroxide, while not deemed essential to the success of the present invention, serves to aid in enhancing the reaction of the oxygen and/or ozone with the components of the pulp.

Figure 1:
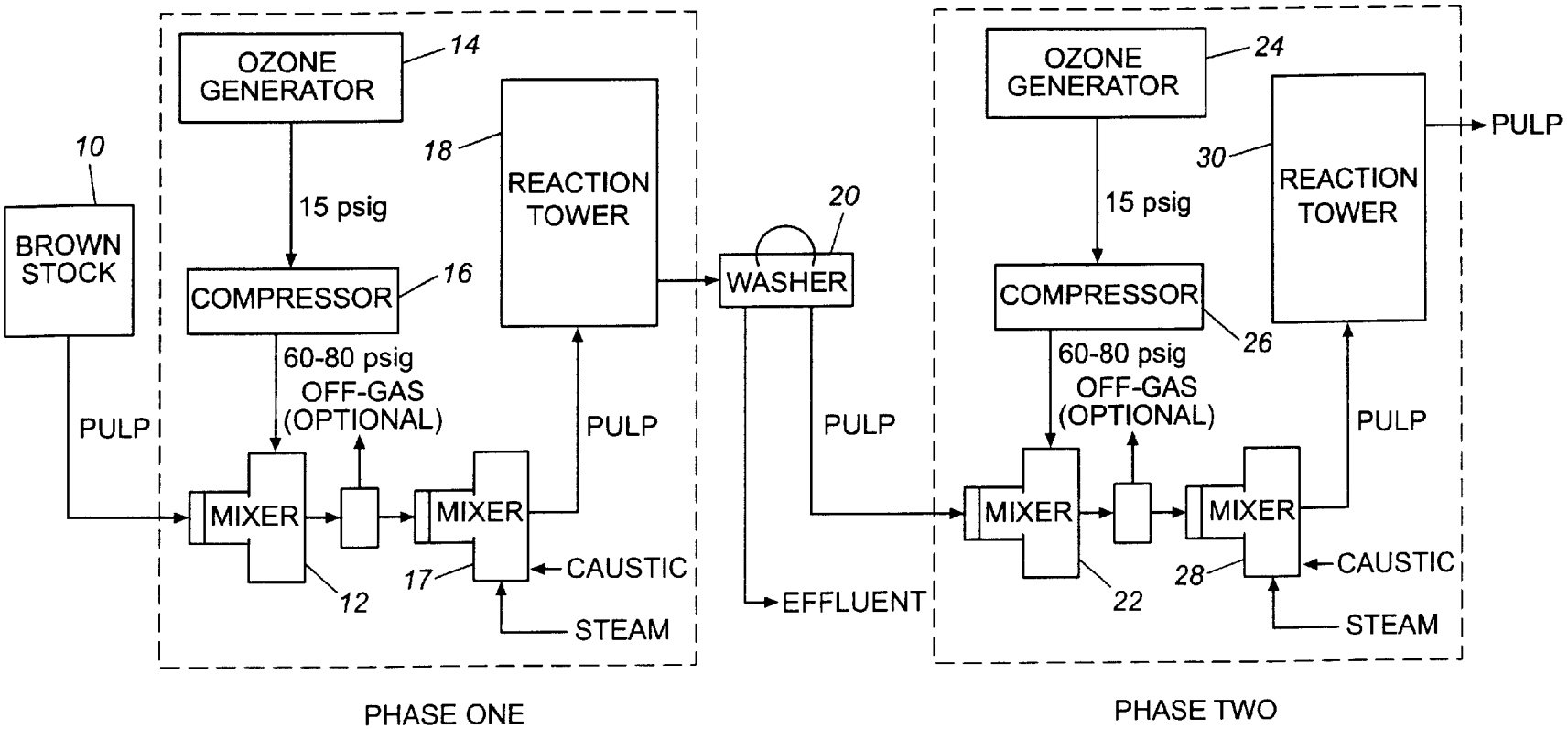
FIG. 1 is a schematic diagram of a two-phase process for post-digestion treatment of kraft pulps embodying various of the features of the present invention.

From the second mixer 17, the pulp is fed to a reaction tower 18 or the like and held for a time sufficient for at least a majority, and preferably substantially all of the oxygen in the pulp to react with components of the pulp. This time period may range from a few minutes up to three or more hours.

Following substantial completion of the reaction of the oxygen with components of the pulp, the pulp is fed from the reaction tower 18 through a washer 20 wherein the pulp is washed with water which may be fresh water or wash liquid, e.g. white water, recycled from other locations in the process such as downstream treatment stages, such as extraction stages, etc. The effluent from the washer 20 is directed either to the sewer or to a reclamation operation, as desired.

After the pulp has passed through this initial treatment phase comprising the series of steps outlined hereinabove, it is subjected to a further and substantially identical treatment phase, beginning with the addition of fresh ozone/oxygen mixture to the pulp in a third mixer 22, the ozone/oxygen mixture originating and compressed in the ozone generator 24 and the compressor 26. As required, the pH and the temperature of the washed pulp may be adjusted as necessary to establish those conditions within the pulp which are favorable to the reaction of the ozone with components of the pulp, and which are unfavorable to the reaction of oxygen to components of the pulp. The remaining steps of this further treatment phase are substantially identical to the steps of the first phase, and include conveying the pulp to and through a fourth mixer 28, thence to and through a reaction tower 30.

After the pulp has been processed through the two-phase treatment (identified by the dash lines in FIG. 1), it may be further processed as desired through further conventional bleaching stages. The present inventor has found, however, that such additional stages of treatment are unnecessary in achieving target values of brightness and viscosity of the pulp where the pulp is intended for use in the manufacture of diapers and similar grades of paper products.

In the present process, the kraft pulp from the digestor has a pH in the 5–9 range, usually below a pH of about 8. Within the mixer 12, the temperature of the pulp is established and maintained between about 20° C. and about 50° C. Within this range, the ozone is caused to react with components of the pulp in preference to the reaction of the oxygen with components of the pulp. The acidity of the pulp is also important in that under high alkaline conditions of the pulp, the ozone is consumed by moieties other than the lignin of the pulp which desirably are to react with the ozone.

Figure 2:
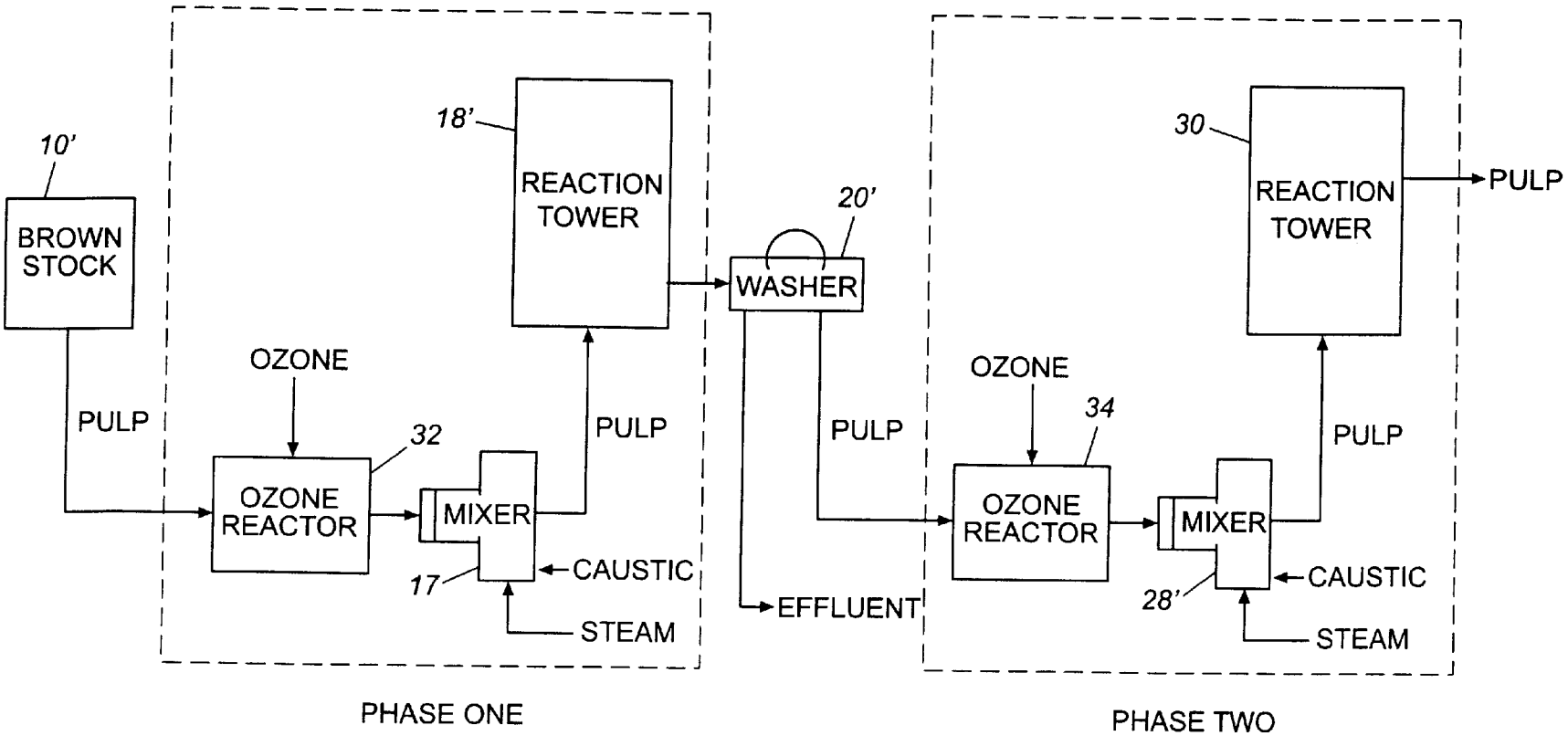
FIG. 2 is a schematic diagram of an alternative embodiment of a two-phase post-digestion treatment of kraft pulps embodying various of the features of the present invention.

With reference to FIG. 2, there is depicted an alternative embodiment of a process employing various of the features of the present invention. In FIG. 2, those process components which are the same as in FIG. 1 have been assigned prime numbers. In the process depicted in FIG. 2, the pulp is treated the same as depicted and described with reference to FIG. 1 with the exception that in the process depicted in FIG. 2, the ozone is added to the pulp in a first ozone reactor 32 in phase one and is added to the pulp in a second ozone reactor 34 in phase two. This alternative embodiment is useful if the mill does not have a suitable mixer.

Further, in accordance with the present invention, the mixture of ozone and oxygen employed is generated employing a conventional ozone generator and compressed to a pressure of between about 60 and 80 psig before being introduced to either of the mixers 12 and 22. In the prior art, a conventional ozone generator is capable only of generating a mixture of ozone with oxygen with the ozone representing less than about 10% of the volume of the mixture. Using a conventional ozone generator, the mixture is compressed to only about 15 psig. This results in the total quantity of ozone in the mixture available for reaction with the pulp to be less than about 1.0% by volume. This limitation relates to the inherent highly reactive chemical nature of ozone which is commonly believed to be unstable, even possibly decomposing, at higher pressures. The present inventor has found, however, that a mixture of ozone and oxygen in which the ozone represents only about 10% or less by volume of the gaseous mixture, can be compressed up to 80 psig without deleterious effect upon the ozone. As a result it has also been found possible to introduce to the mixer less volume of the ozone/oxygen mixture but a greater quantity of ozone. In a preferred embodiment, the quantity of ozone employed is between about 0.15 and 0.5% (based on o.d. pulp) and most preferably between 0.05 and 0.5%. Following completion of the ozone reaction with components of the pulp, the pH of the pulp is adjusted to an alkaline state (preferably a pH of between about 10 and about 13) as by the addition thereto of sodium hydroxide or like alkali, and the temperature of the pulp is increased to between about 70 and 110° C. At these conditions of pH, the oxygen in the pulp reacts with components of the pulp. The pulp preferably is transferred from the mixer to a reactor, such as a reaction tower 24, where it is held for a time period sufficient for completion of the reaction between the oxygen and the components of the pulp. This time period may vary from about 10 minutes to three hours or more.

In a specific example of the two-phase treatment process of the present invention, 247 gm (oven dried) of southern pine kraft pulp having a Kappa No. of 16 and a viscosity of 24.8 cP was adjusted to 1% consistency and treated in an ozone reactor. The pulp in the ozone reactor was at 20° C. and a pH of 2. The quantity of ozone consumed was 0.25%, on pulp fed to a laboratory mixer identified as a Quantum mixer. To the pulp in the mixer there was added 2.5% NaOH. Thereafter the temperature of the pulp in the mixer was adjusted to 82° C., the consistency of the pulp adjusted to 10%, and oxygen at 45 psig was introduced to the mixer. This oxygen flow was gradually reduced to zero psig over a 45 minute time period.

The prior art includes various bleaching sequences, each of which employs oxygen and/or ozone as a delignification agent. Examples of these prior art bleaching sequences include:

(1) Soteland, N., Bleaching of Chemical Pulps with Oxygen and Ozone, Pulp and Paper Magazine of Canada, 75 (4): 91–96 (1974). The process of this reference is depicted schematically below:

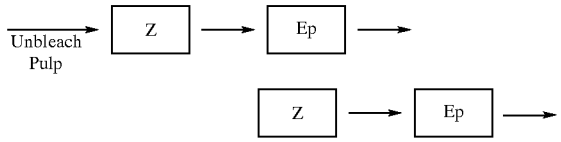

(2) U.S. Pat. No. 4,568,420, Multi-stage Bleaching Process Including an Enhanced Oxidative Extraction Stage, Inventor: Nonni, A. The process of this reference is depicted schematically below:

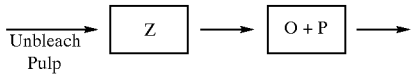

(3) U.S. Pat. No. 5,011,572, Two Stage Process for the Oxygen Delignification of Lignocellulosic Fibers with Peroxide Reinforcement in the First Stage, Inventors: Parthasarathy et al. The process of this reference is depicted schematically below:

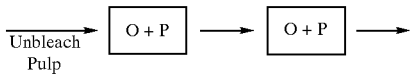

For comparison purposes, a southern pine kraft brown stock, P. No. 21.1, was processed in accordance with each of the above process 1 through 3, and in accordance with the process of the present invention. When ozone was employed in a process, the pulp was at room temperature and 30% consistency. In the O+P step, the pulp was at 85° C., 10% consistency, and the step was carried out in a Quantum reactor; single stage for 150 min and two-stages 60 min first stage and 90 min second stage. The $E_p$ step was the same as the O+P step, but in a plastic bag. The results of these comparison tests are given in Table I.

TABLE I

| Processes | Total Chemical (% on pulp) Z | P | Delignification P. No. | % Red | Pulp Viscosity (cP) | Viscosity /P No. |
|---|---|---|---|---|---|---|
| Soteland's ZEpZEp | 0.8 | 1.2 | 12.06 | 42.8 | 18.2 | 1.509 |
| U.S. Pat. No. 4,568,420 Z(O + P) | 0.8 | 1.2 | 9.26 | 56.1 | 15.0 | 1.620 |
| (U.S. Pat. No. 5,011,572) (O + P)(O + P) | 0 | 1.2 | 9.26 | 56.1 | 15.6 | 1.685 |
| Present Invention (ZO + P)(ZO + P) | 0.8 | 1.2 | 6.24 | 70.4 | 11.0 | 1.763 |

From Table I it may be seen that even though the several processes are alike at first glance, when employing the present inventive process, there is a material enhancement in delignification rate (percent reduction in lignin (% red)), and selectivity of the delignification process which is taking place (defined as the product viscosity divided by the P. No. of the pulp—represents the slope of the curve for degradation of viscosity of the pulp). Table II presented below shows that a southern pine kraft pulp of Kappa No. 16 and a viscosity of 24.8 cP processed in accordance with the present invention exhibits enhanced brightness (representative of delignification) and selectivity over a similar process employing a single phase $zE_0$ process.

TABLE II

| Sequences | Brightness (% GE) | Viscosity (cP) | P. No. | Viscosity/ P. No. |
|---|---|---|---|---|
| $zE_o$ | 36.7 | 20.8 | 7.4 | 2.9 |
| $(zE_o)$ $(zE_o)$ | 54.0 | 13.1 | 3.2 | 4.1 |

What is claimed is:

1. In the treatment of kraft pulp comprising wood fibers to render the pulp useful in end use applications requiring a pulp viscosity of at least about 10 cP and a P. No. of at least about 9 and wherein said pulp has been digested employing a kraft process, the improvement comprising a two-phase post-digestion treatment, including contacting, in a mixer, the digested, unbleached pulp at a low alkaline pH with a mixture of ozone and oxygen pressurized to between about 60 psig and about 100 psig in an initial, chlorine free bleaching stage, said ozone in said mixture being present in an amount of between about 0.15% and 0.5%, based on the dry weight of the pulp, and wherein the temperature of said pulp in said mixer is maintained below the temperature at which oxygen will react with the components of said pulp and at or above the temperature at which said ozone will react with components of said pulp so that essentially all of said ozone in said mixture is consumed by reaction with the components of said pulp while a substantial portion of said oxygen in said mixture remains unreacted in said pulp, and thereafter altering the pH of said pulp to an alkaline pH and increasing the temperature of said pulp containing said oxygen to a temperature at which the oxygen in said pulp will react with components of said pulp for a period of time sufficient for said oxygen to react with said pulp components, thereafter subjecting said pulp to a conventional water washing step, and after said washing step, subjecting the washed pulp to a further second phase including repeating the aforesaid procedure employing the washed pulp and further ozone/oxygen mixture.

2. The improvement of claim 1 and including the step of introducing to said pulp, either before the addition of said ozone/oxygen mixture or at the time of adjusting the pH of said pulp to an alkaline pH, a quantity of peroxide.

3. The improvement of claim 1 and including the step of reducing by up to 50% the quantity of oxygen present in said pulp following the consumption of said ozone by reaction with components of said pulp.

4. The improvement of claim 1 wherein the temperature of said pulp, at the time of introduction of said ozone/oxygen mixture thereto, is between about 20° C. and about 60° C.

5. The improvement of claim 1 wherein the temperature of said pulp, at the time of the adjustment of the pH thereof to an alkaline pH, is adjusted upwardly to between about 65° C. and about 120° C.

6. The improvement of claim 1 wherein the selectivity of said treatment of said pulp is 1.7 or greater.

* * * * *

UNITED STATES PATENT AND TRADEMARK OFFICE

CERTIFICATE OF CORRECTION

PATENT NO. : 6,231,718 B1
DATED : May 15, 2001
INVENTOR(S) : Ted Yuan Tsai

It is certified that error appears in the above-identified patent and that said Letters Patent is hereby corrected as shown below:

Column 1,
Line 23, delete "exposure" and insert -- expense --.

Column 5,
Line 48, delete "$zE_o$" and insert -- ZO --.
Table II, under "Sequences" column, in line 53, delete "$zE_o$" and insert -- ZO --.
Table II, under "Sequences" column, in line 54, delete "$(zE_o)(zE_o)$" and insert -- (ZO) (ZO) --.

Signed and Sealed this

Eighteenth Day of December, 2001

*Attest:*

*Attesting Officer*

JAMES E. ROGAN
*Director of the United States Patent and Trademark Office*